US005482514A

United States Patent [19]

von Raven

[11] Patent Number: 5,482,514

[45] Date of Patent: Jan. 9, 1996

[54] PROCESS FOR ENHANCING THE WHITENESS, BRIGHTNESS AND CHORMATICITY OF PAPER MAKING FIBRES

[75] Inventor: Axel von Raven, Seeshaupt, Germany

[73] Assignee: Ciba-Geigy Corporation, Ardsley, N.Y.

[21] Appl. No.: 119,463

[22] Filed: Sep. 9, 1993

[30] Foreign Application Priority Data

Sep. 14, 1992 [DE] Germany ..... 42 30 655.8

[51] Int. Cl.[6] ..... D06L 3/12; D21C 1/00

[52] U.S. Cl. ..... 8/110; 8/107; 8/108.1; 8/109; 8/116.1; 8/194; 8/196; 8/181; 8/648; 252/8.7; 252/301.21; 162/72; 162/74; 162/76; 162/79

[58] Field of Search ..... 8/116.1, 107, 110, 8/181, 194, 196, 648, 646, 108.1, 109; 252/8.7, 8.8, 8.9, 301.21, 301.22, 301.25, 301.34; 162/72, 74, 76, 77, 79, 82

[56] References Cited

U.S. PATENT DOCUMENTS

| | | | |
|---|---|---|---|
| 2,124,256 | 7/1938 | Mayer | 8/139 |
| 3,479,349 | 11/1969 | Alliseen et al. . | |
| 3,669,896 | 6/1972 | Preininger et al. | 252/301.3 |
| 3,927,967 | 12/1975 | Speakman | 8/103 |
| 3,960,589 | 6/1976 | Morrison et al. | 106/296 |
| 3,984,399 | 10/1976 | Weber et al. . | |
| 4,294,654 | 10/1981 | Turner | 162/50 |
| 4,311,605 | 1/1982 | Eckhardt et al. | 252/102 |
| 4,665,165 | 5/1987 | Wald | 540/124 |
| 4,853,143 | 8/1989 | Hardy et al. | 252/102 |
| 4,990,280 | 2/1991 | Thorengaard et al. | 252/95 |
| 5,139,760 | 8/1992 | Ogawa et al. | 423/328 |
| 5,232,535 | 8/1993 | Brinley | 156/219 |

FOREIGN PATENT DOCUMENTS

| | | |
|---|---|---|
| 33142 | 3/1973 | Australia . |
| 32159 | 10/1907 | Austria . |
| 1150908 | 8/1983 | Canada . |
| 2025467 | 9/1970 | France . |
| 2151727 | 4/1972 | Germany . |
| 2715721 | 10/1977 | Germany . |
| 2943652 | 4/1981 | Germany . |
| 3400161 | 7/1984 | Germany . |
| 3542719 | 6/1986 | Germany . |
| 3626777 | 2/1988 | Germany . |
| 3436015 | 3/1990 | Germany . |
| 4006277 | 9/1990 | Germany . |
| 647799 | 11/1980 | Switzerland . |
| 286495 | 11/1971 | U.S.S.R. . |
| 1079717 | 3/1984 | U.S.S.R. . |
| 1232719 | 5/1986 | U.S.S.R. . |
| 1134767 | 11/1968 | United Kingdom . |
| 1211812 | 11/1970 | United Kingdom . |
| 1372036 | 10/1974 | United Kingdom . |
| 1394910 | 5/1975 | United Kingdom . |
| 1537512 | 12/1978 | United Kingdom . |
| 2068428 | 8/1981 | United Kingdom . |
| 2148344 | 5/1985 | United Kingdom . |
| 2168984 | 7/1986 | United Kingdom . |

OTHER PUBLICATIONS

Derw. Abst. 71–66977S, Nov. 9, 1971.
Derw. Abst. 89–376261, Aug. 27, 1989.
Derw. Abst. 87–346688, Apr. 23, 1987.
Derw. Abst. 72–63413T (date unknown).
Derw. Abst. 88–04363/07 of DE 3,626,777, Feb. 11, 1988.
Derw. Abst. 84–183714/30 of DE 3,400,161, Jul. 19, 1984.
F. Müller; Optische Aufheller; Allegmeine Papier–Rundschau, Apr. 31, 1970, pp. 1120, 1122 & 1124.
Textil–Rundschau, Jul. 1961, pp. 390–398 "Tabelle der Textilhilfsmittel".
Derw. Abst. 86–345743/52 of SU 1,232,719, May 23, 1986.
Derw. Abst. 84–275178/44 of SU 1,097,717, Mar. 15, 1984.
Derw. Abst. 84–183714/30 of DE 3,400,161, Jul. 18, 1984.
Derw. Abst. 86–345753/52 of SU 1,232,719 May 23, 1986.
Derw. Abst. 87–346688/49, Apr. 23. 1987.
Derw. Abst. 84–251591/41, Oct. 4, 1984.
Derw. Abst. 83–721153/30, Sep. 15, 1982.
Derw. Abst. 34579T–AEF, May 18, 1972.
Derw. Abst. 74695V/43, Oct. 17, 1974.
Derw. Abst. 71232U–AF, Jul. 30, 1973.
Derw. Abst. 31934V/17. Apr. 3, 1974.
Derw. Abst. 26755W/16 Mar. 22, 1975.
Derw. Abst. 09476X/06. Jan. 29, 1976.
Derw. Abst. 16254E/09, Mar. 3, 1982.
Derw. Abst. 76844A/43, Oct. 19, 1978.

*Primary Examiner*—Prince Willis, Jr.
*Assistant Examiner*—Alan D. Diamond
*Attorney, Agent, or Firm*—George R. Dohmann

[57] ABSTRACT

The present invention relates to the addition of photosensitising compounds to woodpulps and mixtures thereof for enhancing their whiteness, brightness and chromaticity, as well as to the paper making fibres so obtained and the use thereof.

17 Claims, No Drawings

PROCESS FOR ENHANCING THE WHITENESS, BRIGHTNESS AND CHORMATICITY OF PAPER MAKING FIBRES

The present invention relates to the addition of photosensitising compounds to paper making fibres and mixtures thereof for enhancing their whiteness, brightness and chromaticity, as well as to the paper making fibres so obtained and the use thereof.

Throughout this specification the term "paper making fibres" shall be understood as meaning essentially woodpulps such as groundwood pulp and chemical pulp.

The discussion on the environmental impact of bleaching chemical pulp with active chlorine has led to an ever increasing number of bleaching systems, including hydrogen peroxide, ozone and oxygen, being used in the pulp industry. It has been found, however, that certain losses in strength properties result from the use of chlorine-free bleached chemical pulps.

In the manufacture of woodpulps for graphic papers, the bleach necessary for enhancing whiteness is an essential process step that determines the quality of the pulp and thus also of the finished product.

Lignins, lignin-type phenols and extract substances as well as their degradation products are responsible for causing the brownish-yellow color of unbleached woodpulp. Because of the presence of conjugated double bonds and auxochromic groups, all these compounds form chromophoric systems.

Only bleaching agents that contain carbohydrates and lignins are suitable for bleaching woodpulp so as not to lower its stability. The increase in whiteness requires a specific destruction of the chromophoric groups, preferably without slushing. The chromophoric system is chemically modified but is still present, so that the coloration can recur after a certain time. This is the reason for the pronounced yellowing tendency of woodpulp paper.

When bleaching groundwood pulp, the necessary level of whiteness is often not achieved despite high concentrations of $H_2O_2$, so that an additional reductive bleaching, conveniently with sodium dithionite, must be carded out. This two-step process necessitates not only increased costs, but also destroys the $H_2O_2$ still present whose biocidal activity is then no longer available during paper manufacture.

Despite modem bleaching processes, paper making fibres furthermore have a more or less pronounced degree of yellowness. If it is desired to reduce the yellow tinge of paper making fibres to achieve chromaticity in the desired range, then a blue dye must be added, and to reduce a reddish tinge a greenish-blue dye must be added etc. The addition of such dyes results in a certain loss of whiteness and, in particular, in a very marked drop in brightness.

Accordingly, the invention relates to a process for enhancing the whiteness, brightness and chromaticity of paper making fibres or mixtures thereof by adding photoactivators.

To achieve this object, preferably the photoactivator or a mixture of photoactivators, in the absence or presence of further auxiliary components such as surfactants, typically dodecyl sulfate, chelating agents such as phosphates, and fillers such as zeolites, as well as the paper making fibres or mixtures thereof, are thoroughly mixed with water. It is preferred to mix the ingredients thoroughly in the temperature range from 10° to 90° C. and, most preferably, from 20° to 85° C., for more than half an hour, preferably for 1 to 4 hours, to ensure good mixing with atmospheric oxygen. The pH of the suspension during mixing is preferably 7.0 to 11. Mixing can conveniently be effected by stirring, circulation pumping or blowing in air.

The amount of photoactivator is normally from 0.0001 to 0.1% and, preferably, from 0.0005 to 0.03%, based on the amount of paper making fibres used.

The suspension of the catalytically bleached paper making fibres so obtained can afterwards be dried, but can also be further processed in this form immediately. An additional advantage of the novel process resides in the strength of the bleached paper making fibres obtained.

Another advantage is the catalytic course of the process, the photoactivator (catalyst) preventing a recurrence of yellowing through its retention by the paper making fibres. It is therefore also expedient to combine the photoactivators with conventional bleaching processes. The photoactivators can be added before, during or after the conventional bleaching process. For practical reasons, it is preferred to add bleaching agent and photoactivator simultaneously.

The paper making fibres bleached by the novel process exhibit not only an improvement in whiteness, brightness and chromaticity, but also a reduced yellowing tendency as well as enhanced strength properties.

Photoactivators which may suitably be used for the process of this invention are all dyes that have a photodynamic effect, typically eosin, Rose Bengal, fluorescein, chlorophyll, porphyrin compounds, methylene blue or mixtures thereof. Preferred dyes are the water-soluble phthalocyanines, for example the phthalocyanine metal complexes of aluminium, zinc, manganese, magnesium, calcium, iron, sodium or potassium. These compounds may be used singly or in admixture.

Preferred photoactivators are the compounds of formula (1)

$$\left[\text{MePC}\right]\begin{matrix} R_x \\ (SO_3Y)_v \end{matrix} \qquad (1)$$

and mixtures thereof, wherein

MePC is the zinc, manganese or aluminium phthalocyanine ring system,

Y is hydrogen, an alkali metal or ammonium, preferably hydrogen, potassium or sodium, v is any number from 1 to 4, preferably a number from 2 to 4, R is fluorine, chlorine, bromine or iodine, preferably chlorine or bromine, x is any number from 0 to 8, preferably (if MePC is the zinc or aluminium phthalocyanine ring system) any number from 0.8 to 2.

The photoactivators and their preparation are commonly known in the art and some are used for bleaching textiles (GB-A-1 372 036, US-A-3 927 967, DE-A-2 613 936, DE-A-2 8 12 278). In contradistinction to the conditions described in these references, irradiation with light and the addition of builder substances as well as detergents are, surprisingly, not necessary.

The paper making fibres eligible for use in the process of this invention typically comprise chemical pulp, groundwood pulp, waste paper or mixtures thereof. Exemplary of woodpulps are groundwood (GW), pressure groundwood (PGW), refiner mechanical pulp (RMP), thermomechanical pulp (TMP) and chemithermomechanical pulp (CTMP).

The invention further relates to the paper making fibres and mixtures thereof treated by the novel process, and to their use in the pulp industry and, in particular, in paper manufacture.

The invention still further relates to the papers made from the paper making fibres treated by the novel process.

The paper making fibres and mixtures thereof are used in the pulp and, especially, in the paper industry. For this utility they can be blended with further components such as fluorescent whitening agents, binders such as latex, acrylic acid or styrene polymers or their copolymers; fillers and other auxiliaries such as polyethgylene glycol or glycol ethers.

Particularly useful synergistic effects are also obtained by combining photoactivators with fluorescent whitening agents such as diphenylbistyryls.

The invention is illustrated by the following non-limitative Examples in which percentages, unless otherwise indicated, are by weight. The term "o.d." (= ovendry) relates to the dry weight of the paper making fibres in grams.

Example 1: The respective amount of paper making fibres indicated in Table 1 is weighed into a 1 liter polyethylene flask with screw top, corresponding to 3.0 o.d. (56.6 g of A; 200 g of B). After addition of 500 ml of distilled water, the further components listed in Table 1 are added and the pH is adjusted, as required, with sodium hydroxide solution.

The photoactivators of formulae (2) and (3) are used as 0.1% solutions.

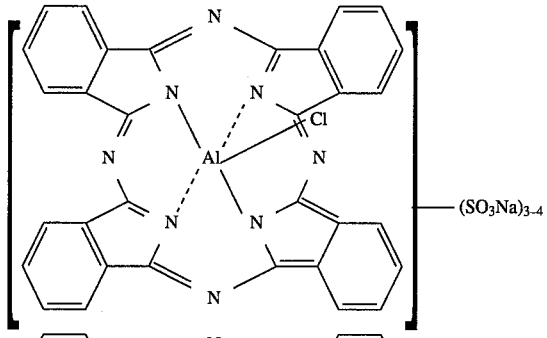

(2)

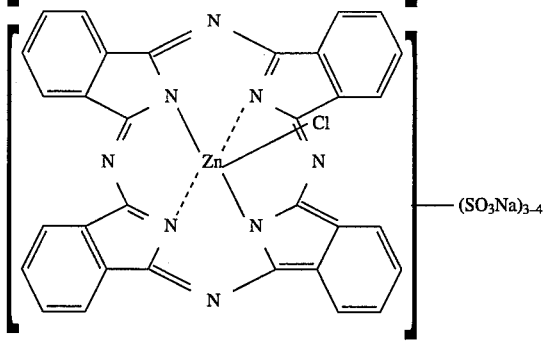

(3)

TABLE 1

| Experiment | | Photoactivator [ml] | | Dodecyl sulfate | Phosphate | Rawesol ® | | |
|---|---|---|---|---|---|---|---|---|
| No. | Pulp | (2) | (3) | [%] | [%] | [%] | pH | Whiteness |
| 1 | A | — | — | — | — | — | a | 66.80 |
| 2 | A | 0.5 | — | — | — | — | a | 67.91 |
| 3 | A | 1.0 | — | — | — | — | a | 67.58 |
| 4 | A | 2.5 | — | — | — | — | a | 67.85 |
| 5 | A | — | 0.5 | — | — | — | a | 67.40 |
| 6 | A | — | 1.0 | — | — | — | a | 67.47 |
| 7 | A | — | 2.5 | — | — | — | a | 67.86 |
| 8 | A | 1.0 | — | 0.05 | 0.2 | — | a | 67.29 |
| 9 | A | — | 1.0 | 0.05 | 0.2 | — | a | 67.26 |
| 10 | A | 1.0 | — | 0.05 | — | 0.2 | a | 67.51 |
| 11 | A | — | 1.0 | 0.05 | — | 0.2 | a | 68.01 |
| 12 | A | 1.0 | — | 0.05 | — | 0.2 | 7.5 | 67.26 |
| 13 | A | 1.0 | — | 0.05 | — | 0.2 | 9/6 | 67.05 |
| 14 | B | — | — | — | — | — | a | 88.15 |
| 15 | B | 1.0 | — | 0.05 | 0.2 | — | 9.0 | 88.29 |
| 16 | B | 1.0 | — | 0.05 | — | 0.2 | 9.0 | 88.75 |
| 17 | B | — | 1.0 | 0.05 | 0.2 | — | 9,0 | 88.30 |
| 18 | B | — | 1.0 | 0.05 | — | 0.2 | 9.0 | 88.63 |
| 19 | B | — | 1.0 | 0.05 | — | 0.2 | 9/6 | 88.88 |

pulp A = moist woodpulp, solids content 5.3%
pulp B = bleached short fiber pulp (hardwood kraft pulp, solids content 1.5%
a) = pH was not adjusted
9/6 = pH initially adjusted to 9.0 and after the reaction to 6.0
Rawesol = special zeolite The flasks are closed and the mixtures (except for the blank tests) are shaken vigorously for 1 hour on a mechanical shaker. Upon termination of the reaction time, the pH is adjusted, where indicated, to 6.0 with sulfuric acid.

After dilution to 3 1 (experiments 1–8) and 7 1 (experiments 9–20), paper sheets are made from the mixtures on a Rapid-K/öthen sheet former and, after drying (7 min at 95° C.), the whiteness is determined using an apparatus in accordance with the requirements of DIN 53145 part 1.

The results reported in Table 1 show an increase in whiteness in the samples bleached with photoactivators over the unbleached controls (Nos 1 and 14)

The photoactivators of formulae (2) and (3) can also be replaced with the corresponding manganese compound.

Example 2: The samples obtained in Example 1 are stored for the period of time indicted in Table 2 and the whiteness is later determined. The experiment numbers of Table 2 refer to those in Table 1.

TABLE 2

| Experiment No. | 1 day after manufacture | 4 weeks without light | 5 days sunlight | 10 days sunlight | Difference 1 day–10 days |
|---|---|---|---|---|---|
| 1 | 66.80 | 66.20 | 64.80 | 63.25 | 3.55 |
| 2 | 67.90 | 67.70 | 66..5 | 65.75 | 2.15 |
| 4 | 67.85 | — | 65.70 | 64.65 | 3.2 |
| 7 | 67.86 | — | 65.90 | 65.10 | 2.76 |
| 11 | 68.01 | 68.00 | 66.55 | 65.20 | 2.81 |
| 14 | 88.2 | | 86.6 | 86.5 | 1,7 |
| 16 | 88.7 | | 87.7 | 87.4 | 1.3 |
| 19 | 88.9 | | 87.6 | 87.4 | 1.5 |

The results reported in Table 2 show that the tendency to yellowing of the untreated papers (samples 1 and 14) is markedly greater than those of the papers treated with photoactivator.

Example 3: A bag bleach is carried out with woodpulp (SGW) of 50 o.d. This is done by spraying the groundwood pulp with the chemicals indicated in Table 3, with constant mixing, at 70° C. from a spray bottle for 2 hours at pH 7.5.

TABLE 3

| Conditions | Experiment No. 1 | 2 | 3 |
|---|---|---|---|
| waterglass [%] | 2.5 | — | — |
| NaOH [%] | 1.5 | — | — |
| $H_2O_2$ [%] | 2.0 | 2.0 | 2.0 |
| Rawesol [%] | — | 3 | 3 |
| compound(2) [mg/kg] | — | — | 300 |
| whiteness [%] | 69.0 | 68.3 | 70.4 |
| luminosity RY | 83.1 | 82.2 | 82.1 |
| tristimilus value K x | 0.3245 | 0.3245 | 0.3130 |
| tristimulus value k y | 0.3518 | 0.3520 | 0.3496 |

The results reported in Table 3 show that, even using a peroxide bleach, by adding the photoactivators it is possible to achieve a further increase in whiteness as well as a shift of the chromaticity without a noticeable loss of brightness.

Example 4: The respective amount of paper making fibres is weighed into a 1 liter polyethylene flask corresponding to 6.0 o.d.(30.2 g of A; 30.7 g of B). After addition of 800 ml of distilled water, the auxiliaries are added in the amounts indicated in Table 4. The mixtures obtained are stirred vigorously for c. 4 hours at room temperature (except the blank tests).

Paper sheets are formed from the mixtures on a Rapid-Kitchen sheet former and, after drying (7 min at 95° C.), the whiteness is determined using an apparatus that meets the requirements of DIN 53 145, Part 1.

TABLE 4

| Experiment No | Pulp | Photoactivator [ml 0.1% soln] (2) | (3) | Rawesol ® [% based on o.d.] | Whiteness [%] |
|---|---|---|---|---|---|
| 1 | A | — | — | — | 60.4 |
| 2 | B | — | — | — | 60.8 |
| 3 | A | 0.5 | — | — | 60.8 |
| 4 | A | 1.0 | — | — | 63.0 |
| 5 | A | 1.5 | — | — | 63.4 |
| 6 | A | 1.0 | — | 0.2 | 63.4 |
| 7 | A | — | 1.0 | — | 63.7 |
| 8 | A | — | 2.0 | — | 63.5 |
| 9 | B | 0.5 | — | — | 62.5 |
| 10 | B | 1.0 | — | — | 62.0 |
| 11 | B | 1.0 | — | 0.2 | 62.3 |

TABLE 4-continued

| Experiment No | Pulp | Photoactivator [ml 0.1% soln] (2) | (3) | Rawesol ® [% based on o.d.] | Whiteness [%] |
|---|---|---|---|---|---|
| 12 | B | — | 1.0 | — | 62.2 |

pulp A = thermomechanical wood pulp of 19.9% solids content
pulp B = waste paper of 19.5% solids content Example 5: A thermomechanical wood pulp (TMP) for coating base paper (stock consistency c.6%) is removed direct from industrial production and photoactivator (2) of Table 5 is added. Each batch is processed with 20 g of o.d. thermomechanical wood pulp (TMP) of 3% stock consistency with constant stirring at 55° C.

TABLE 5

| Conditions | Experiment No. 1 | 2 | 3 | 4 | 5 |
|---|---|---|---|---|---|
| compound (2) [mg/kg o.d.] | — | 50 | 80 | 150 | 150 |
| pH | 7.0 | 7.0 | 7.0 | 7.0 | 7.0 |
| duration [hours] | 3 | 3 | 3 | 3 | 6 |
| whiteness | 63.9 | 66.2 | 66.6 | 66.3 | 66.7 |
| luminosity [%] | 77.55 | 79.8 | 80.0 | 78.9 | 78.9 |
| tristimulus value K x | 0.3379 | 0.3350 | 0.3335 | 0.3318 | 0.3305 |
| tristimulus value K y | 0.3559 | 0.3563 | 0.3565 | 0.3560 | 0.3560 |

Example 6: Pulp samples or boards are immersed for c.5 minutes in a 0.001% solution of compound (2) and then dried at room temperature in daylight.

The values reported in Table 6 are obtained by measuring the whiteness of an unbleached sample and a sample bleached as described above.

TABLE 6

| | without (2) | with (2) |
|---|---|---|
| whiteness | 79.93 | 83.05 |
| luminosity y [%] | 87.35 | 87.70 |
| tristimulus value K x | 0.3249 | 0.3190 |
| tristimulus value K y | 0.4342 | 0.3387 |

Example 7: A bag bleach is carried out with 50 o.d. wood pulp. The wood pulp is sprayed with the chemicals listed in Table 3, with constant mixing, from a spray flask containing the bleach solution.

| Bleaching conditions: | |
|---|---|
| stock consistency | c.20% |
| water glass | 2.8% |
| NaOH | 2.7% |
| $H_2O_2$ | 2,5% |
| temperature | 70° C. |
| bleaching time | 2.5 hours |

After bleaching, the stock is acidified to about pH 7 with sulfuric acid and 80 mg of compound (2) per kg of wood pulp are added.

For addition of the chemical auxiliary, the groundwood pulp is diluted to 3 % at pH 8.5.

Paper sheets are formed from the mixtures on a Rapid-Köthen sheet former and, after drying (7 min at 95° C.), the whiteness is determined using an apparatus that meets the requirements of DIN 53 145, Part 1.

The strength of the paper sheets is determined according to Brecht-Imset (tear strength test), DIN 53115, and the breaking length according to DIN 53112.

TABLE 7

| | without (2) | with (2) |
|---|---|---|
| whiteness | 65.2 | 66.4 |
| luminosity | 81.1 | 80.9 |
| tear length [m] | 2523 | 3345 |
| tear strength [mJ/m] | 925 | 942 |

What is claimed is:

1. A process for enhancing the whiteness, brightness and chromaticity of paper-making fibers, which comprises mixing water, paper-making fibers and a photoactivator to form an aqueous suspension, wherein said photoactivator is one or more than one water-soluble phthalocyanine complex of the formula (1)

$$\left[\text{MePC}\right]^{R_x}_{(SO_3Y)_v} \quad (1)$$

wherein

MePc is a manganese, zinc or aluminum phthalocyanine ring system,

Y is hydrogen, an alkali metal or ammonium, v is any number from 1 to 4,

R is fluorine, chlorine, bromine or iodine, and x is any number from 0 to 8.

2. A process according to claim 1, wherein the pH of the suspension is in the range from 7.0 to 11.

3. A process according to claim 1, wherein the suspension is stirred thoroughly for longer than half an hour.

4. A process according to claim 3, wherein the suspension is stirred thoroughly for 1 to 4 hours.

5. A process according to claim 1, wherein the suspension is stirred thoroughly in the temperature range from 10° to 90° C.

6. A process according to claim 5, wherein the suspension is stirred thoroughly in the temperature range from 20° to 85° C.

7. A process according to claim 1, wherein the amount of photoactivator is from 0.0001 to 0.1%, by weight, based on the amount of paper making fibres.

8. A process according to claim 7, wherein the amount of photoactivator is from 0.0005 to 0.03%, by weight, based on the amount of paper making fibres.

9. A process according to claim 1, wherein the photoactivator is one or more than one compound of formula (1)

$$\left[\text{MePC}\right]^{R_x}_{(SO_3Y)_v} \quad (1)$$

wherein

MePC is the zinc or aluminum phthalocyanine ring system,

Y is hydrogen, an alkali metal or ammonium, v is any number from 1 to 4,

R is fluorine, chlorine, bromine or iodine, and x is any number from 0 to 8.

10. A process according to claim 1, wherein the photoactivator is one or more than one compound of formula (1 )

$$\left[\text{MePC}\right]^{R_x}_{(SO_3Y)_v} \quad (1)$$

wherein

MePC is the manganese phthalocyanine ring system,

Y is hydrogen, an alkali metal or ammonium, v is any number from 1 to 4,

R is fluorine, chlorine, bromine or iodine, and x is any number from 0 to 8.

11. A process according to claim 9, wherein the photoactivator is one or more than one compound of formula (1), wherein Y is hydrogen, potassium or sodium, v is a number from 2 to 4, R is chlorine or bromine, x is any number from 0 to 2.

12. A process according to claim 10 wherein photoactivator is one or more than one compound of formula (1), wherein Y is hydrogen, potassium or sodium, v is a number from 2 to 4, R is chlorine or bromine, x is any number from 0 to 2.

13. A process according to claim 11, wherein the photoactivator is one or more than one compound of formula (1), wherein MePC is the zinc or aluminum phthalocyanine ring system and x is any number from 0.8 to 2.

14. A process according to claim 1, wherein the paper making fibres are selected from the group consisting of chemical pulp, groundwood pulp, waste paper and mixtures thereof.

15. A process as claimed in claim 1, which comprises adding the photoactivator or photoactivators to the suspension before, during or after the paper-making fibers are subjected to a conventional bleaching process.

16. Paper making fibres prepared by the process as claimed in claim 1.

17. A process as claimed in claim 1, wherein the suspension contains a fluorescent whitening agent in addition to the paper-making fibers and the photoactivator.

* * * * *